US011143984B2

(12) United States Patent
Nagashima et al.

(10) Patent No.: US 11,143,984 B2
(45) Date of Patent: Oct. 12, 2021

(54) TONER CONVEYING DEVICE WITH VIBRATION GENERATOR ATTACHED THERETO AND IMAGE FORMING APPARATUS INCLUDING THE SAME

(71) Applicant: KYOCERA Document Solutions Inc., Osaka (JP)

(72) Inventors: Teruhiko Nagashima, Osaka (JP); Hiroaki Kitagawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/064,851

(22) Filed: Oct. 7, 2020

(65) Prior Publication Data

US 2021/0124287 A1 Apr. 29, 2021

(30) Foreign Application Priority Data

Oct. 29, 2019 (JP) ..... JP2019-196413

(51) Int. Cl.
*G03G 15/08* (2006.01)
*G03G 21/10* (2006.01)

(52) U.S. Cl.
CPC ..... *G03G 15/0889* (2013.01); *G03G 15/0808* (2013.01); *G03G 15/0896* (2013.01); *G03G 21/105* (2013.01); *G03G 2215/0154* (2013.01); *G03G 2215/0852* (2013.01); *G03G 2215/0872* (2013.01); *G03G 2221/0021* (2013.01)

(58) Field of Classification Search
CPC ..... G03G 15/0889; G03G 15/0808; G03G 15/0815; G03G 15/0877; G03G 15/0887; G03G 15/891; G03G 15/893; G03G 15/0896; G03G 15/095; G03G 21/10; G03G 21/105; G03G 21/102; G03G 21/1642; G03G 21/1647; G03G 2215/0154; G03G 2215/0811; G03G 2215/0813; G03G 2215/0852; G03G 2215/0872; G03G 2221/0021; G03G 2221/0052; G03G 2221/0089; G03G 2221/1678

See application file for complete search history.

(56) References Cited

U.S. PATENT DOCUMENTS 8,280,296 B2 * 10/2012 Ichikawa ..... G03G 15/0877 399/360
2015/0023686 A1 * 1/2015 Mukataka ..... G03G 21/206 399/93
2015/0370215 A1 * 12/2015 Sugita ..... F16H 57/12 399/167

FOREIGN PATENT DOCUMENTS

JP 2014-006411 1/2014

* cited by examiner

*Primary Examiner* — Joseph S Wong
(74) *Attorney, Agent, or Firm* — Lex IP Meister, PLLC

(57) ABSTRACT

A toner conveying device conveys toner supplied from outside. The toner conveying device includes a housing, a plurality of toner acceptors, a plurality of legs, a bracket, and a vibration generator. The housing has a toner conveyance path inside. The toner acceptors are provided on the housing to accept toner supplied from outside and guide the toner to the toner conveyance path. The legs are fixed near the toner acceptors on the housing, respectively, and protrude outward from a side surface of the housing. The bracket is supported by each of the legs. The vibration generator is attached to the bracket.

7 Claims, 17 Drawing Sheets

TONER CONVEYING DEVICE WITH VIBRATION GENERATOR ATTACHED THERETO AND IMAGE FORMING APPARATUS INCLUDING THE SAME

This application is based upon and claims the benefit of priority from the corresponding Japanese Patent Application No. 2019-196413 filed on Oct. 29, 2019, the entire contents of which are incorporated herein by reference.

BACKGROUND

The present disclosure relates to a toner conveying device that conveys toner supplied from a toner container.

An image forming apparatus, such as a copying machine or a printer, that forms an image on a sheet material, such as printing paper, by an electrophotographic method includes a developing device. In the developing device, a developer containing toner is included. The developing device develops an electrostatic latent image formed on an image carrier such as a photosensitive drum with the toner contained in the developer. As the development is performed, the amount of toner in the developing device decreases. Therefore, the image forming apparatus includes a toner container containing toner and is so constructed as to supply the toner from the toner container to the developing device. The image forming apparatus includes a toner conveying device that conveys the toner from the toner container to the developing device. A housing of the toner conveying device includes a toner acceptor that accepts the toner supplied from the toner container and guides the toner to an internal toner conveyance path. When the toner passes through the toner acceptor, the toner may adhere to and deposit on the inner surface of a guide path of the toner acceptor, thereby inhibiting the toner from flowing into the guide path. In order to remove the deposits, the conventional toner conveying device is provided with a removal member that comes into contact with the inner surface of the guide path to remove the deposits.

However, since the removal member comes into physical contact with the inner surface of the guide path, the removal effect decreases when the removal member deteriorates due to fatigue. In addition, the toner may deposit on the removal member itself, and the inflow of the toner in the guide path may be rather hampered.

In a known proposal, a vibration motor is used to suppress the deposition of toner in the casing of the developing device. By attaching the vibration motor to the toner acceptor of the toner conveying device as above, the deposition of toner in an internal guide path can be suppressed.

SUMMARY

A toner conveying device according to an aspect of the present disclosure conveys toner supplied from outside. The toner conveying device includes a housing, a plurality of toner acceptors, a plurality of legs, a bracket, and a vibration generator. The housing has a toner conveyance path inside. The toner acceptors are provided on the housing to accept toner supplied from outside and guide the toner to the toner conveyance path. The legs are fixed near the toner acceptors on the housing, respectively, and protrude outward from a side surface of the housing. The bracket is supported by each of the legs. The vibration generator is attached to the bracket.

DETAILED DESCRIPTION

Hereinafter, an embodiment of the present disclosure will be described with reference to the drawings as appropriate. It should be noted that the embodiment described below is merely an example, in which the present disclosure is embodied, and does not limit the technical scope of the present disclosure.

Figure 1:
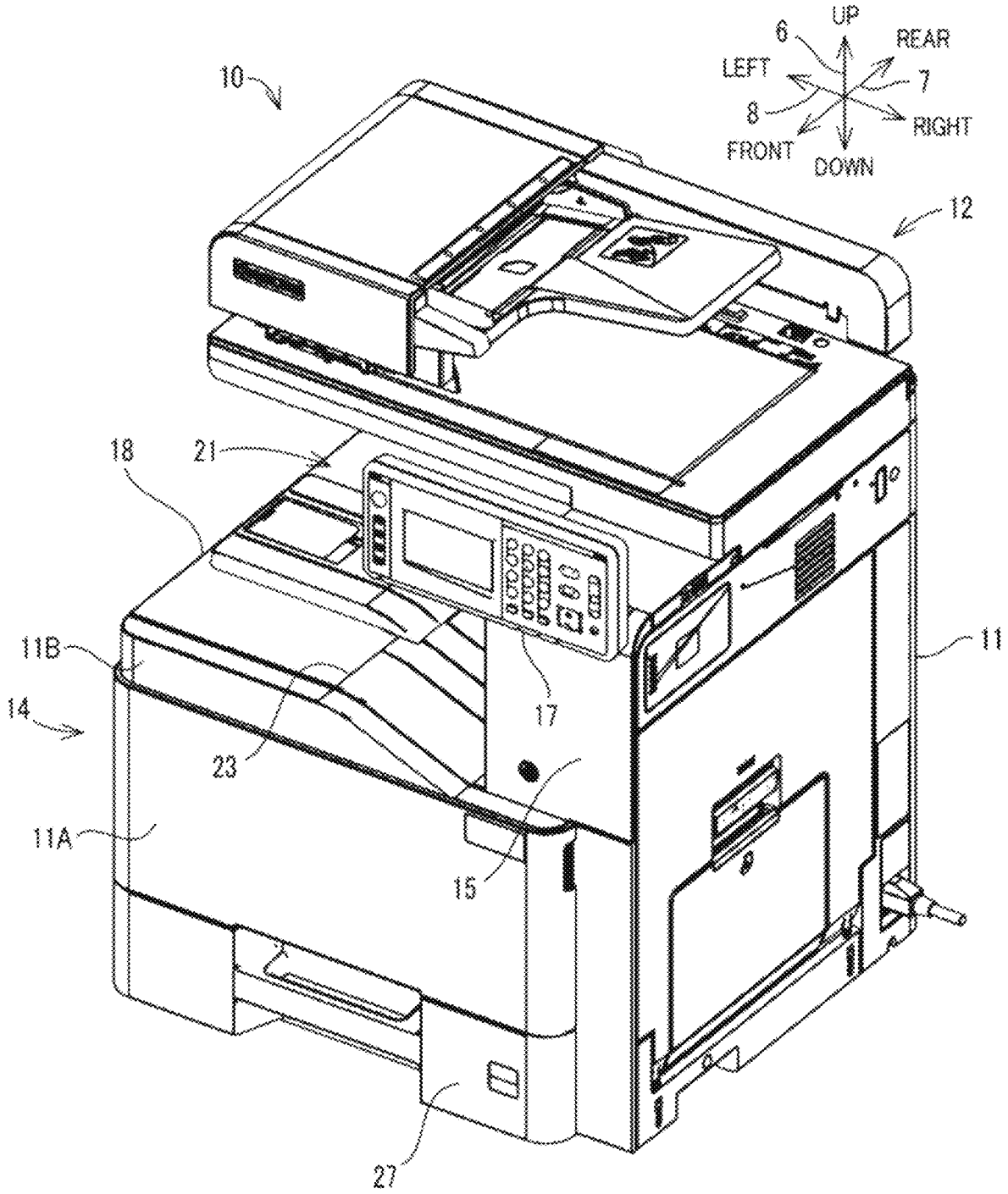
FIG. 1 is a perspective view illustrating an image forming apparatus according to an embodiment of the present disclosure.

FIG. 1 is a perspective view illustrating an image forming apparatus 10 according to an embodiment of the present disclosure. For convenience of description, a vertical direction in an installation state (state illustrated in FIG. 1) in which the image forming apparatus 10 can be used is defined as an up-down direction 6. In addition, a front-rear direction 7 is defined assuming that a side surface, on which an operation display unit 17 is provided in the installation state, be a front surface. A left-right direction 8 is defined on the basis of the front surface of the image forming apparatus 10 in the installation state.

[Image Forming Apparatus 10]

The image forming apparatus 10 has at least a printing function. As shown in FIG. 1, the image forming apparatus 10 is a so-called tandem type color printer. The image forming apparatus 10 prints an image on a sheet material such as printing paper by using a developer containing toner. The image forming apparatus 10 may be any image forming apparatus having the printing function, that is to say, may be a multifunction peripheral having a plurality of functions including the printing function, a facsimile machine or a copying machine. As a matter of course, the image forming apparatus 10 may form a single-color image instead of a color image.

The image forming apparatus 10 includes an image reading part 12 and an image forming part 14. The image reading part 12 performs a process of reading an image of a document, and is provided in an upper portion of the image forming apparatus 10. The image forming part 14 performs a process of forming a color image based on an electrophotographic method, and is provided in a lower portion of the image forming apparatus 10. A sheet discharging part 15 is provided on the right side of the image forming part 14.

A discharge space 21 is provided between the image forming part 14 and the image reading part 12. The sheet discharging part 15 vertically couples the image forming part 14 and the image reading part 12 together while forming the discharge space 21 between the image forming part 14 and the image reading part 12.

The sheet discharging part 15 discharges the sheet material after image formation to the discharge space 21. A sheet discharge port 15A (see FIG. 3) is provided in a left side surface of the sheet discharging part 15 facing the discharge space 21. The sheet discharge port 15A is formed above an end portion 24 of a sheet tray 18 described later. The sheet material is discharged through the sheet discharge port 15A.

The image forming part 14 includes a housing 11 as an apparatus main body. The components of the image forming part 14 are disposed in the housing 11. The housing 11 includes an external frame that covers the entirety of the image forming part 14 and an internal frame that supports the components of the image forming part 14. The housing 11 has a substantially rectangular-parallelepipedic shape as a whole.

Figure 2:
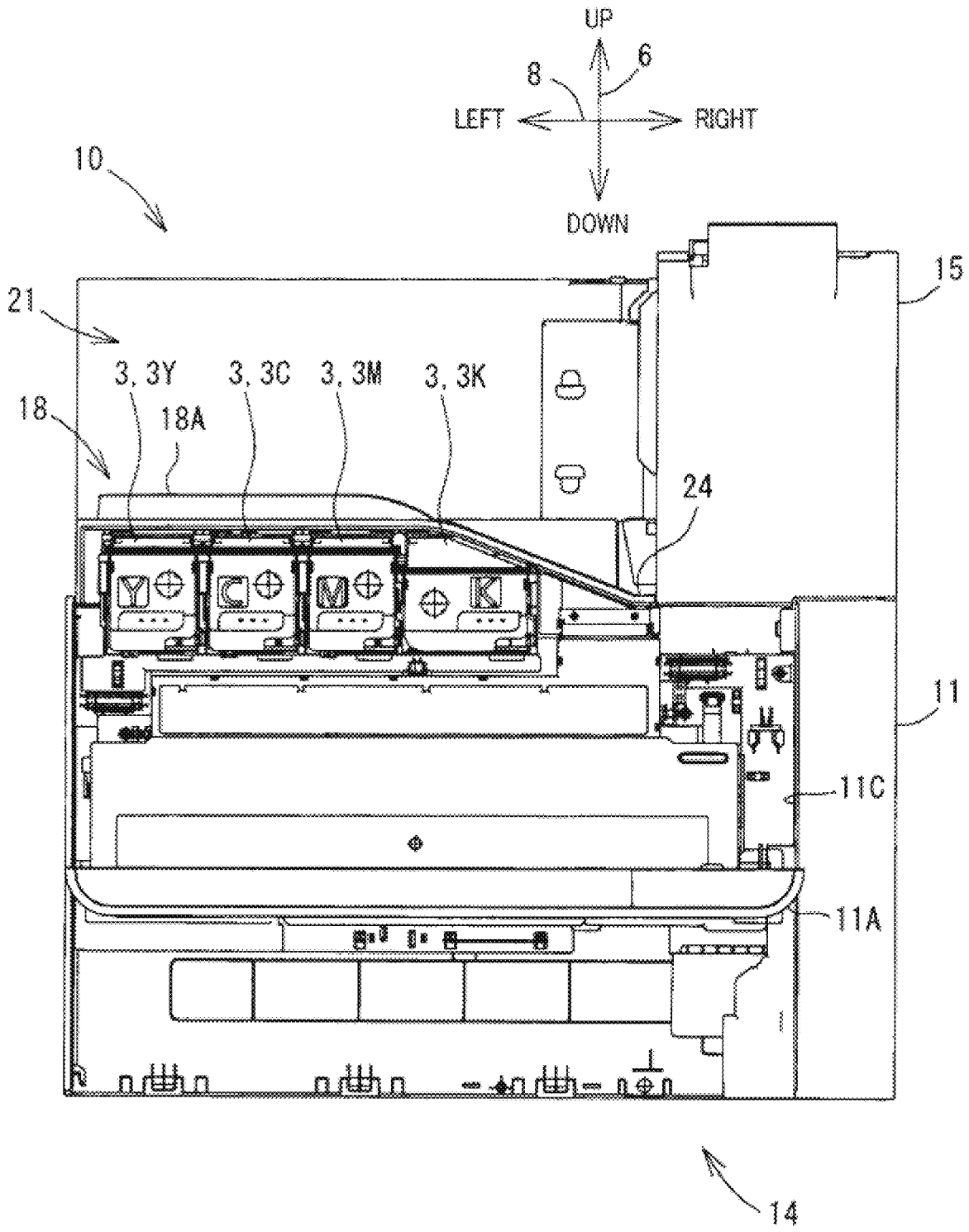
FIG. 2 is a front view illustrating a state, where a front cover of a housing of the image forming apparatus is opened.

The housing 11 includes a front cover 11A and a side cover 11B. An opening 11C (see FIG. 2) in the front surface of the housing 11 is covered by the front cover 11A and the side cover 11B. When the front cover 11A is opened, the inside of the image forming part 14 is made open (see FIG. 2). The side cover 11B is provided on the upper side of the front cover 11A. The upper portion of the opening 11C which cannot be closed by the front cover 11A is closed by the side cover 11B. FIG. 2 shows a state, in which the side cover 11B is removed and the front cover 11A is opened. Toner containers 3 are mounted in the housing 11 through the opening 11C.

Figure 3:
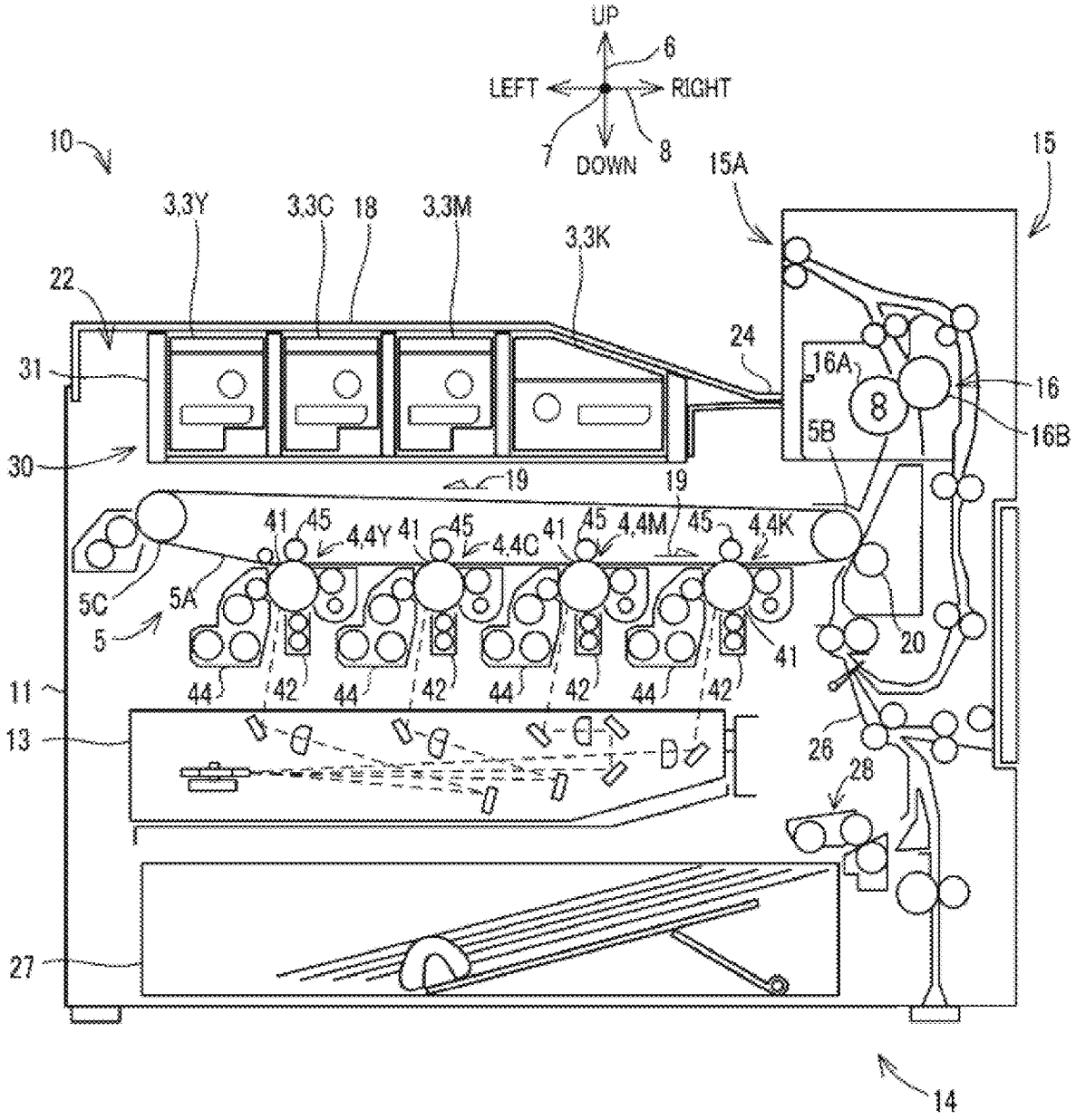
FIG. 3 is a diagram illustrating an internal configuration of an image forming part included in the image forming apparatus.

FIG. 3 is a diagram illustrating an internal configuration of the image forming part 14. In FIG. 3, the image reading part 12 is not shown. The image forming part 14 forms a color image on a sheet material such as printing paper based on a so-called tandem system. As shown in FIG. 3, the image forming part 14 includes four image forming units 4, an intermediate transfer unit 5, an optical scanning device 13, a secondary transfer roller 20, a fixing device 16, the sheet tray 18, a sheet cassette 27, a feeding unit 28, the operation display unit 17 (see FIG. 1), a conveyance path 26, a container mounting part 30, a toner conveying device 60 (an example of the toner conveying device of the present disclosure), and a controller (not shown).

The feeding unit 28 takes out the sheet material as a recording medium sheet by sheet from the sheet cassette 27 and feeds the sheet material toward the conveyance path 26.

Each of the image forming units 4 (4Y, 4C, 4M, 4K) is provided below the intermediate transfer unit 5. The image forming units 4 are arranged side by side along the left-right direction 8 that substantially coincides with a traveling direction (direction indicated by an arrow 19) of a transfer belt 5A. An image forming unit 4Y for yellow, an image forming unit 4C for cyan, an image forming unit 4M for magenta, and an image forming unit 4K for black are arranged in a line in this order from the left side to the right side of the transfer belt 5A.

Each of the image forming units 4 includes a photosensitive drum 41, a charging device 42, a developing device 44, a primary transfer roller 45, and the like. Each image forming unit 4 forms a toner image on the photosensitive drum 41 in accordance with an electrophotographic method and transfers the toner image onto the transfer belt 5A included in the intermediate transfer unit 5 so that the toner images from the image forming units 4 may sequentially be superimposed. The transfer belt 5A is movable in the direction of the arrow 19, and the toner images are sequentially transferred onto the moving transfer belt 5A. The image forming unit 4Y forms a toner image on the surface of the photosensitive drum 41 with yellow toner. The image forming unit 4C forms a toner image with cyan toner, the image forming unit 4M forms a toner image with magenta toner, and the image forming unit 4K forms a toner image with black toner, each on the surface of the photosensitive drum 41. The toner image developing process is performed on the photosensitive drum 41 by the developing device 44.

Figure 4:
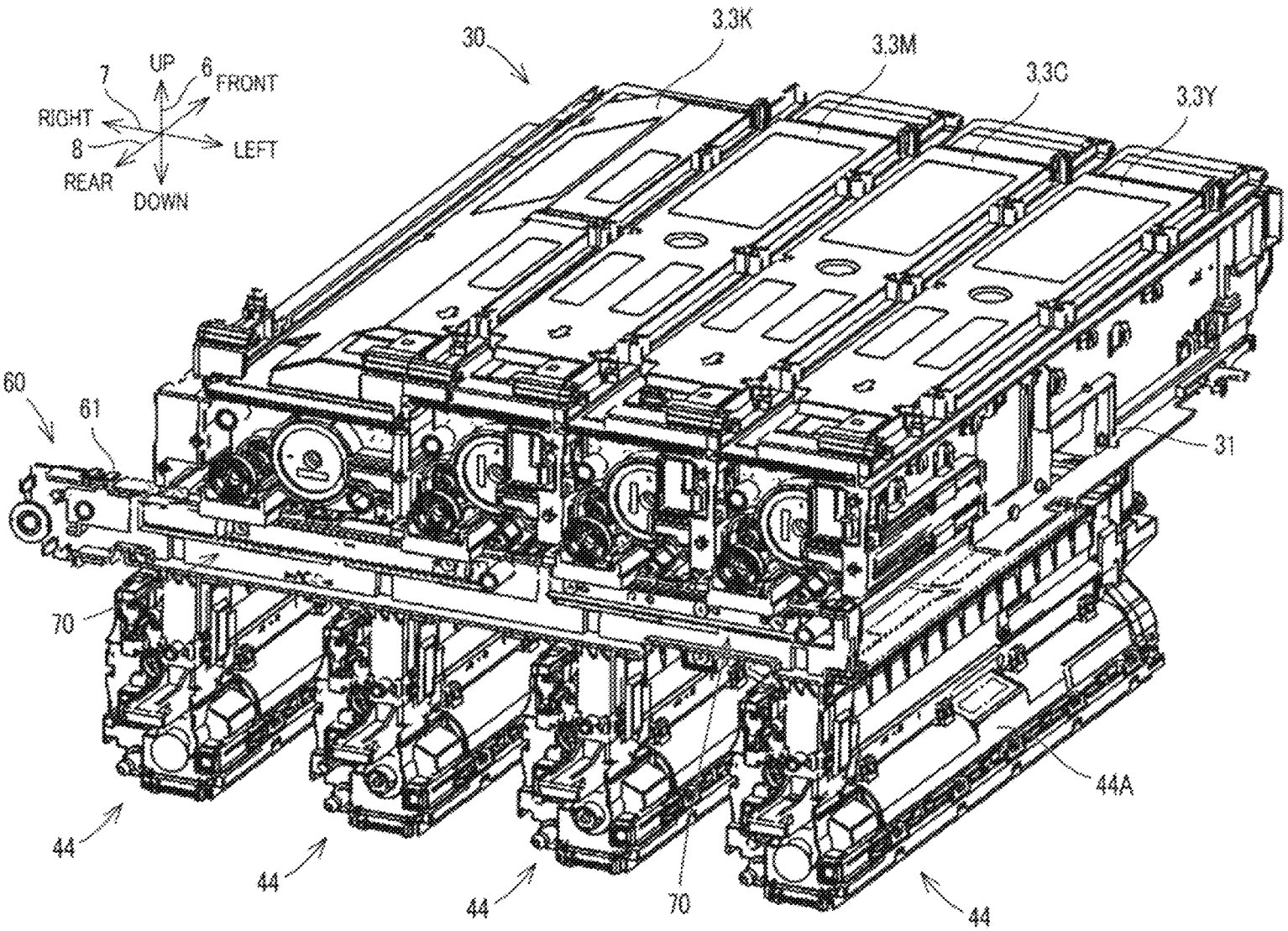
FIG. 4 is a perspective view illustrating a container mounting part, a toner conveying device, and a developing device as obliquely viewed downward in the rear.
Figure 5:
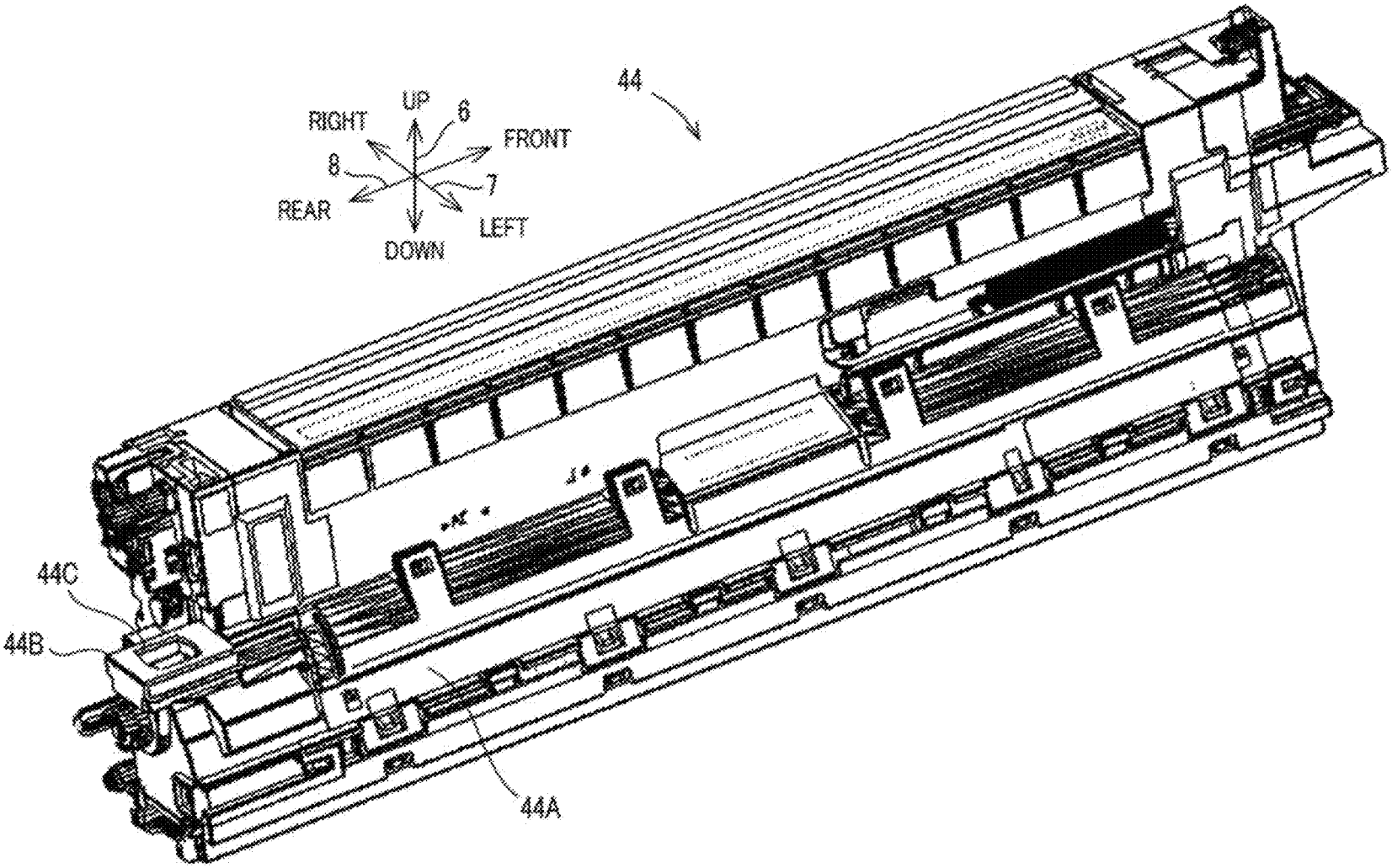
FIG. 5 is a perspective view illustrating a developing device included in the image forming apparatus.

The developing device 44 performs development using a developer containing toner. FIG. 4 is a perspective view illustrating the container mounting part 30, the toner conveying device 60, and the developing devices 44 as viewed from the rear side. FIG. 5 is a perspective view illustrating the developing device 44. As shown in FIGS. 4 and 5, the developing device 44 is in a shape elongated in the front-rear direction 7. A toner supply section 44B (see FIG. 5) is provided on a case main body 44A of the developing device 44. In the toner supply section 44B, a supply port 44C (see FIG. 5) is formed. As shown in FIG. 5, the toner supply section 44B is provided in an end portion on one side in the longitudinal direction of the case main body 44A, specifically, in the end portion on the rear side in a mounting state, in which the developing device 44 is mounted inside the housing 11.

The developing device 44 is detachably provided on the housing 11 so as to allow replacement. A support table (not shown) for supporting the developing device 44 is provided on the internal frame of the housing 11. In a state, where the developing device 44 is mounted on the support table, the toner can be supplied by the toner conveying device 60 to be described later into the developing device 44 through the supply port 44C.

As shown in FIG. 3, the intermediate transfer unit 5 is provided above the image forming units 4 and below the container mounting part 30. The intermediate transfer unit 5 includes the transfer belt 5A, a driving roller 5B, and a driven roller 5C. The transfer belt 5A is a belt member to which a toner image of each color formed on the photosensitive drum 41 of each image forming unit 4 is transferred. The transfer belt 5A is provided above the photosensitive drum 41. The transfer belt 5A is in the form of an endless annular belt. The transfer belt 5A is rotatably supported by the driving roller 5B and the driven roller 5C which are provided separately from each other in the left-right direction 8. The transfer belt 5A is so supported as to stretch between the driving roller 5B and the driven roller 5C. When the transfer belt 5A passes between the photosensitive drums 41 and the primary transfer rollers 45, the toner images are sequentially transferred from the photosensitive drums 41 in a superimposed manner.

The optical scanning device 13 irradiates the photosensitive drum 41 of each image forming unit 4 with a laser light based on the image data of each color as input. Thus, an electrostatic latent image is formed on each of the photosensitive drums 41.

The secondary transfer roller 20 is so provided as to face the driving roller 5B with the vertically extending conveyance path 26 interposed therebetween. The toner image on the transfer belt 5A is transferred to the sheet material by the transfer potential applied to the secondary transfer roller 20. The sheet material, to which the toner image is transferred, is conveyed to the fixing device 16.

The fixing device 16 heats the toner image transferred to the sheet material to fix the toner image to the sheet material, and includes a heating roller 16A and a pressure roller 16B. The sheet material conveyed to the fixing device 16 is further conveyed while nipped between the heating roller 16A and the pressure roller 16B. During this conveyance, heat is transferred from the heating roller 16A to the toner image transferred to the sheet material, and the toner image is heated. Thus, the toner image is fixed to the sheet material. Thereafter, the sheet material is discharged to the sheet tray 18 by the sheet discharging part 15.

As shown in FIG. 3, the sheet tray 18 is provided in the discharge space 21. The sheet tray 18 holds the sheet material, which has passed through the fixing device 16 and has been discharged outside through the sheet discharge port 15A of the sheet discharging part 15. The sheet tray 18 also serves as the external frame, which constitutes an upper surface of the image forming part 14. The sheets of sheet material discharged to the sheet tray 18 are loaded on the sheet tray 18 in an upwardly stacked manner. A plurality of ribs 18A (see FIG. 2) each extending in the left-right direction 8 are formed on an upper surface (sheet placement surface) of the sheet tray 18. The sheet material discharged to the sheet tray 18 is supported by the upper ends of the ribs 18A.

The container mounting part 30 holds four toner containers 3 containing toner. As shown in FIG. 3, the container mounting part 30 is provided above the intermediate transfer unit 5. A storage space 22 is formed between the intermediate transfer unit 5 and the sheet tray 18, and the container mounting part 30 is provided in the storage space 22. That is, the sheet tray 18 is provided above the container mounting part 30, and the intermediate transfer unit 5 is provided below the container mounting part 30. Details of the container mounting part 30 will be described later.

The toner conveying device 60 conveys the toner supplied from the toner containers 3 mounted in the container mounting part 30 to the developing devices 44. As shown in FIG. 4, the toner conveying device 60 is provided behind the container mounting part 30 and the developing devices 44. Details of the toner conveying device 60 will be described later.

[Container Mounting Part 30]

Figure 6:
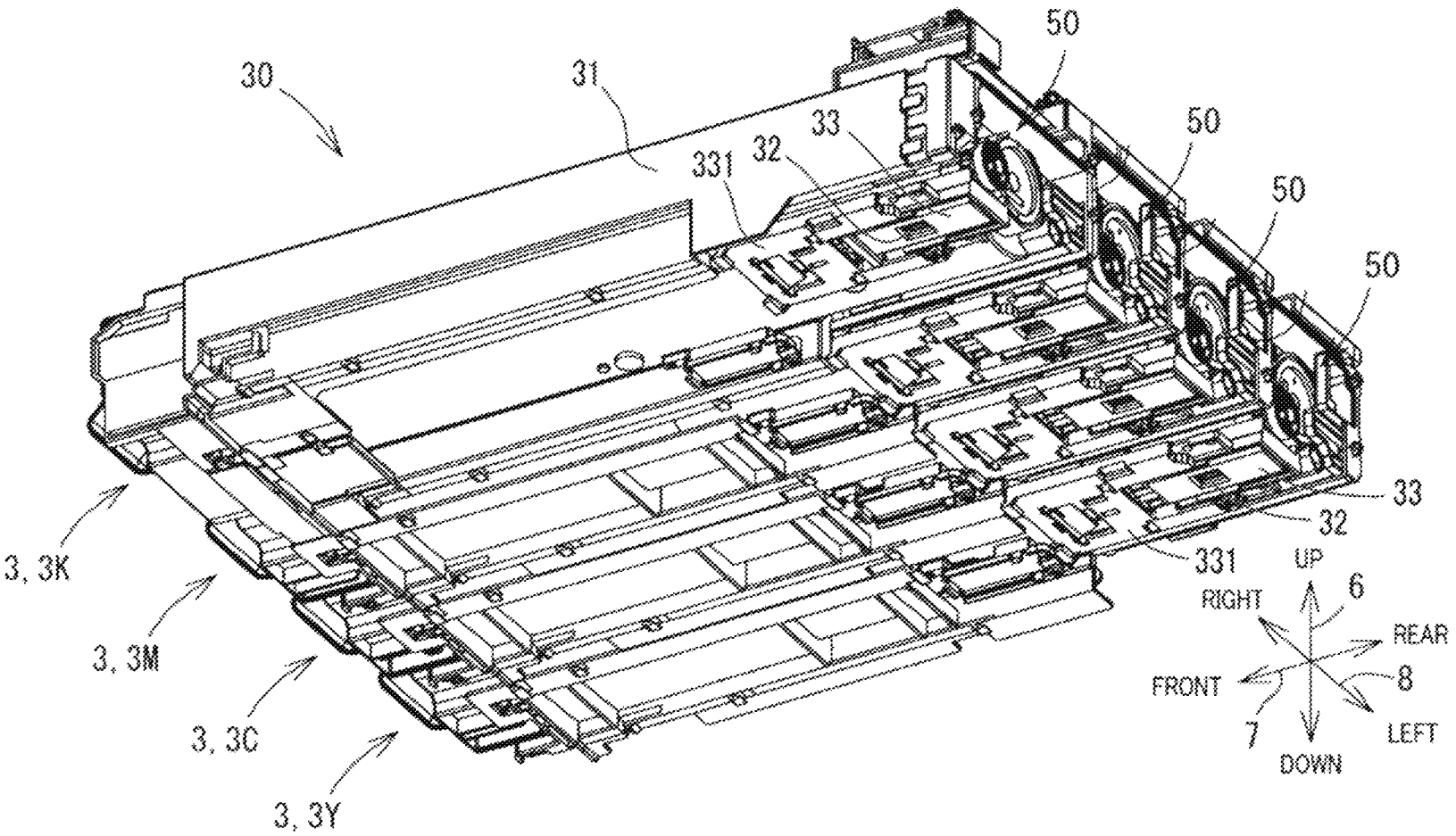
FIG. 6 is a perspective view illustrating the container mounting part as obliquely viewed upward in the rear.

FIG. 6 is a perspective view of the container mounting part 30 as obliquely viewed upward in the rear. FIGS. 4 and 6 each illustrate a state, in which the toner containers 3 are mounted in the container mounting part 30. The container mounting part 30 is fixed to the internal frame of the housing 11. The container mounting part 30 detachably mounts a plurality of toner containers 3. That is, the toner containers 3 are detachably mounted on the image forming apparatus 10 by the container mounting part 30.

The container mounting part 30 includes a support frame 31 that supports each of the toner containers 3 of the respective colors slidably in the front-rear direction 7. On the support frame 31, the toner containers 3 of the respective colors are arranged side by side along the left-right direction 8.

[Toner Container 3]

As shown in FIG. 6, the toner containers 3 are each in a shape elongated in the front-rear direction 7. Each of the four toner containers 3 contains toner of a color corresponding to the color of one image forming unit 4. To be specific, a toner container 3K contains black toner, a toner container 3M contains magenta toner, a toner container 3C contains cyan toner, and a toner container 3Y contains yellow toner. Since the consumption amount of black toner is the largest, the toner container 3K is formed to have a large lateral width and a large volume as compared with any other toner container 3 (3Y, 3C or 3M).

A toner discharge port 32 is formed on the rear side of the bottom of the toner container 3, and a shutter member 33 is provided to open and close the toner discharge port 32. The shutter member 33 is supported by a shutter support member 331 attached to the bottom of the toner container 3 slidably between an opening position and a closing position. When the toner container 3 is mounted in the container mounting part 30, the shutter member 33 slides to open the toner discharge port 32.

A rear end portion of the toner container 3 is provided with a transmission unit 50 that receives a rotational driving force input from the image forming apparatus 10 in a mounting state, in which the toner container 3 is mounted in the container mounting part 30. The transmission unit 50 includes a coupling member, a gear, and the like. The transmission unit 50 is coupled to a joint (not shown) provided in the container mounting part 30 in the mounting state. The transmission unit 50 is coupled to a spiral conveying member 34 (see FIG. 7) provided inside the toner container 3. Thus, when the rotational driving force is input to the transmission unit 50 in the mounting state, the transmission unit 50 rotates the conveying member 34. Thus, the toner in the toner container 3 is conveyed toward the toner discharge port 32.

The toner contained in the toner container 3 is supplied to the toner conveying device 60, which will be described later, through the toner discharge port 32, then conveyed by the toner conveying device 60 to the supply port 44C (see FIG. 5) of the developing device 44, which corresponds to the color of the supplied toner, and supplied into the developing device 44 through the supply port 44C.

[Toner Conveying Device 60]

Figure 7:
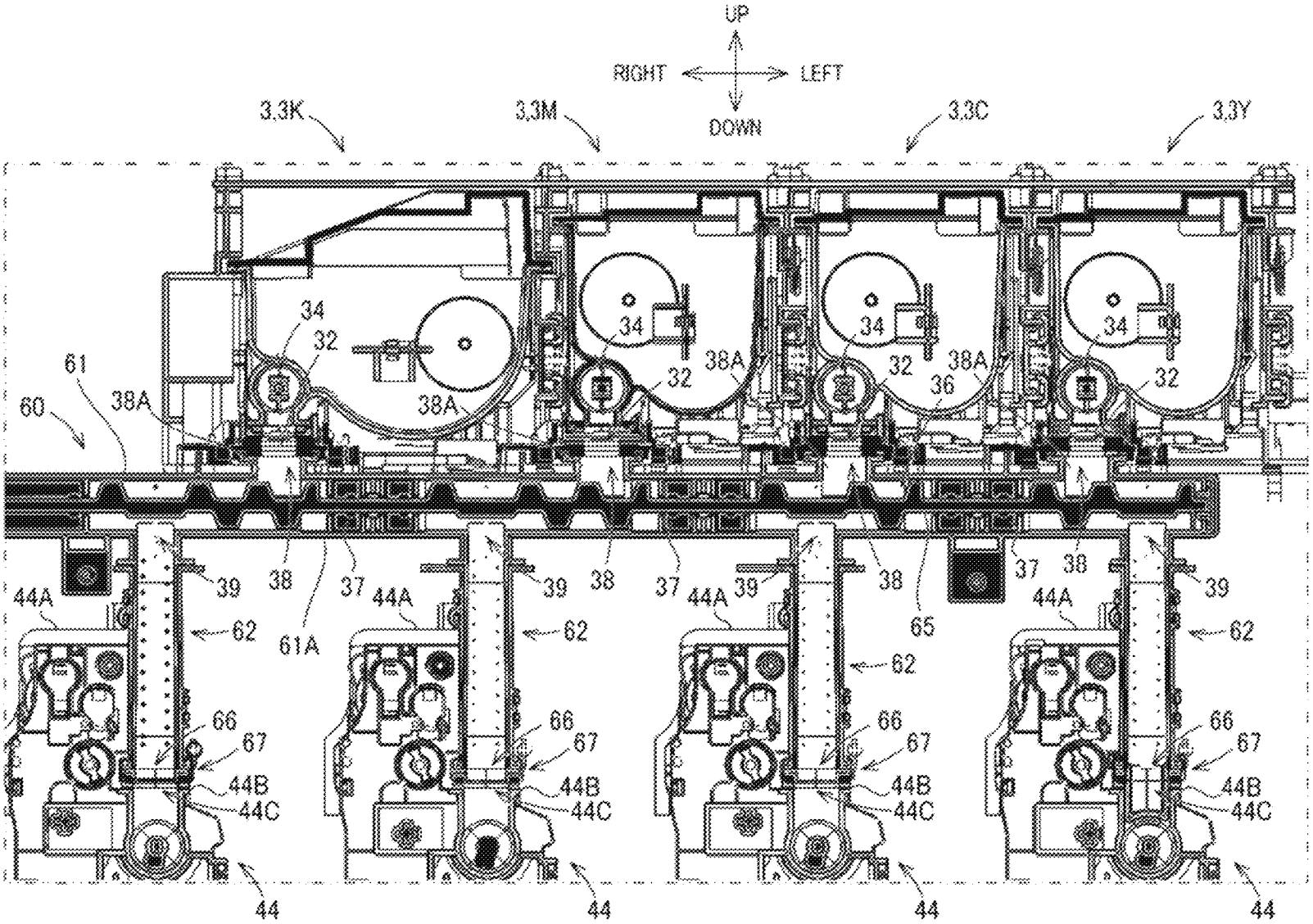
FIG. 7 is a cross-sectional view illustrating a cross-sectional structure of the toner conveying device and the developing device.
Figure 8:
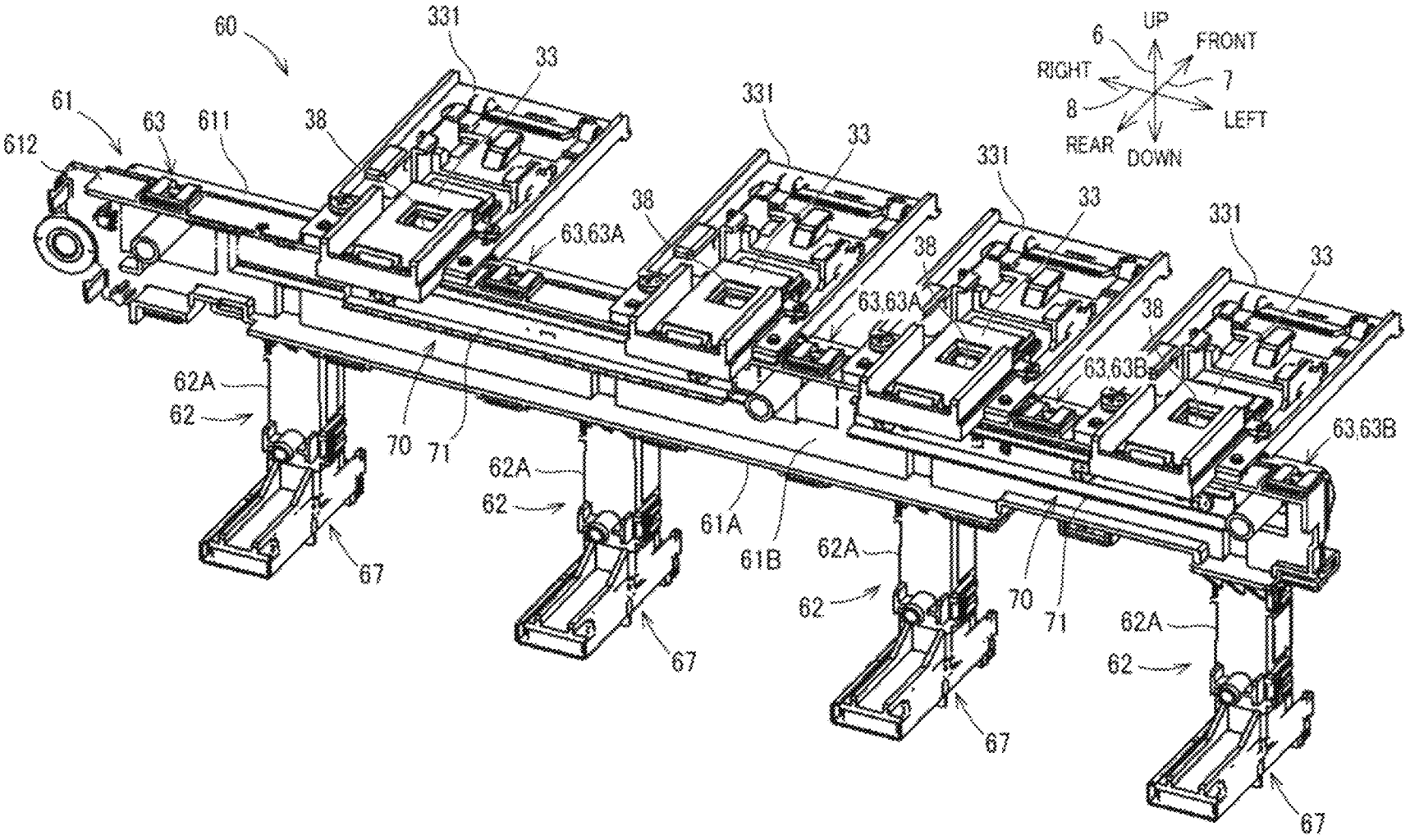
FIG. 8 is a perspective view illustrating the toner conveying device as viewed from the rear side.
Figure 9:
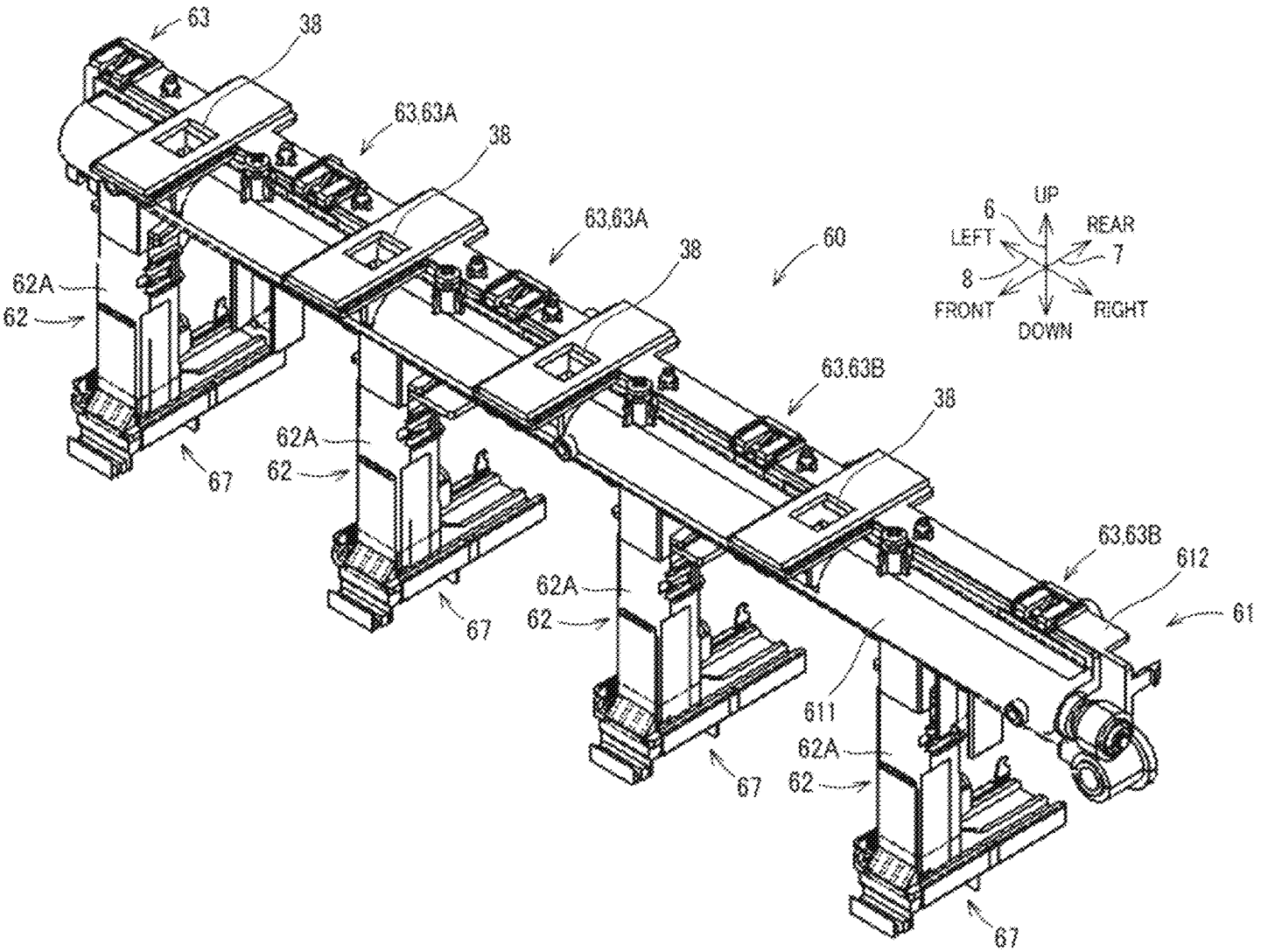
FIG. 9 is a perspective view illustrating the toner conveying device as viewed from the front side.
Figure 10:
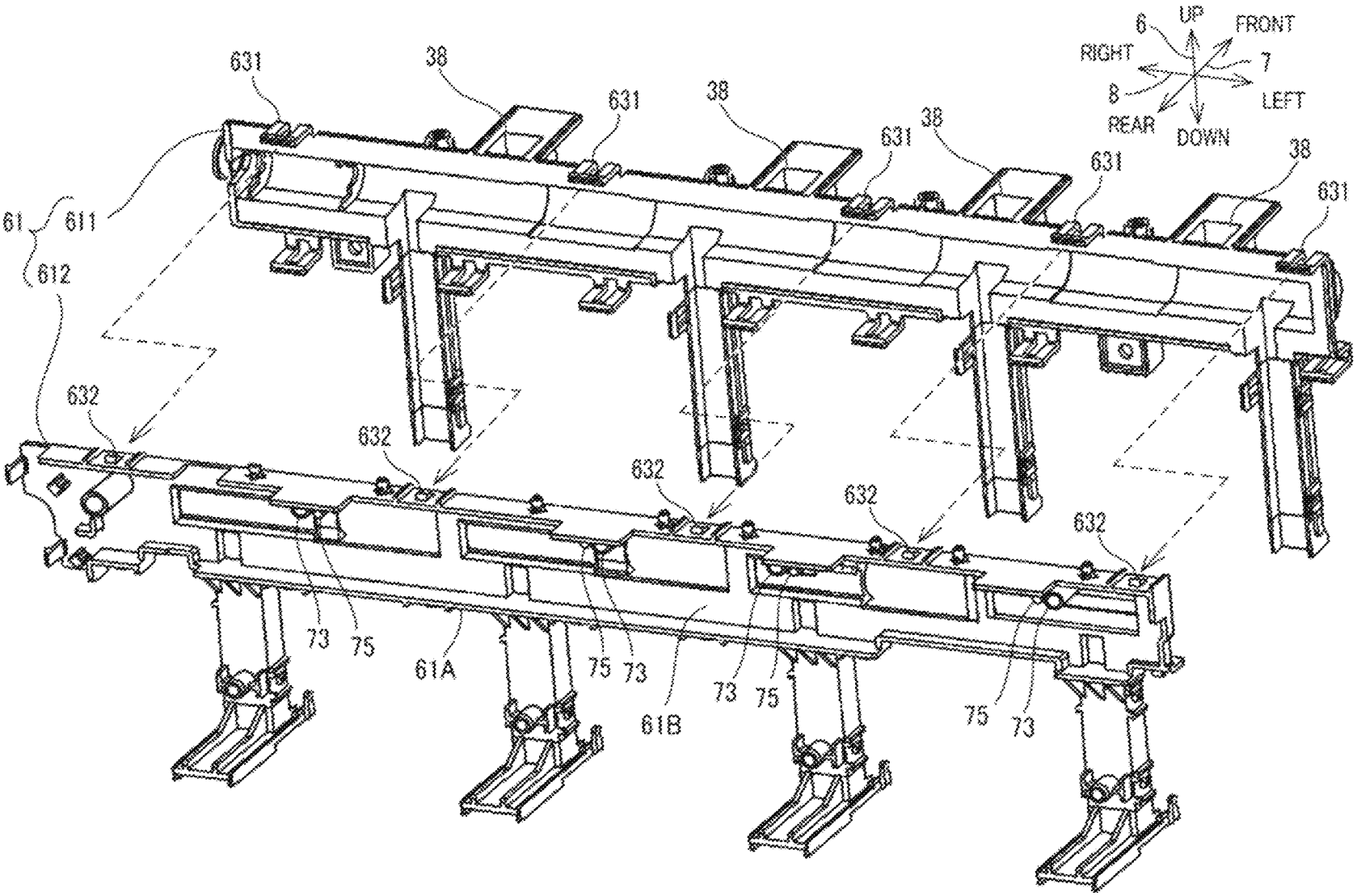
FIG. 10 is an exploded perspective view of a casing included in the toner conveying device.

FIG. 7 is a cross-sectional view of the toner conveying device 60, the container mounting part 30, and the developing devices 44 taken along a cutting plane passing through a toner conveyance path 36 of the toner conveying device 60, as viewed from the rear side. FIGS. 8 and 9 are perspective views showing the configuration of the toner conveying device 60, FIG. 8 being a perspective view showing the toner conveying device 60 as viewed from the rear side and FIG. 9 being a perspective view showing the toner conveying device 60 as viewed from the front side. FIG. 10 is an exploded perspective view of a casing 61 of the toner conveying device 60. In FIG. 8, the shutter support member 331 and the shutter member 33 included in the toner container 3 are illustrated.

The toner conveying device 60 is provided on the rear side of the container mounting part 30 and the developing device 44. The toner conveying device 60 conveys the toner supplied through the toner discharge port 32 of the toner container 3 to the supply port 44C of the developing device 44, and supplies the toner into the developing device 44 through the supply port 44C.

As shown in FIGS. 8 and 9, the toner conveying device 60 includes the casing 61 (an example of the housing of the present disclosure), four toner guides 62, and a conveying member 65.

The casing 61 is made of a synthetic resin, for example, an ABS resin. The casing 61 is formed in a shape elongated in the horizontal direction (left-right direction 8). The casing 61 includes a first casing 611 (an example of the first divided housing of the present disclosure) constituting a front housing and a second casing 612 (an example of the second divided housing of the present disclosure) constituting a rear housing. Each of the first casing 611 and the second casing 612 is formed in a shape elongated in the left-right direction 8 as a portion divided from the casing 61 in the lateral direction (front-rear direction 7) orthogonal to the longitudinal direction of the casing 61. The first casing 611 and the second casing 612 as coupled together in the lateral direction constitute the casing 61.

Five coupling units 63 (an example of the coupling member of the present disclosure) are provided in an upper portion of the casing 61. As shown in FIG. 10, each coupling unit 63 is a coupling member that couples the first casing 611 and the second casing 612 together, and has a so-called snap-fit structure. In the present embodiment, among the five coupling units 63, the four coupling units 63 (63A and 63B) provided on the left side of the casing 61 are each disposed in the vicinity of an acceptance port 38 and a guide passage 38A, which will be described later.

Each coupling unit 63 includes a protruding piece 631 provided on an upper portion of the first casing 611 and a locking claw 632 provided on an upper portion of the second casing 612. An insertion hole, into which the locking claw 632 is inserted in the coupling state, is formed in the protruding piece 631. When the first casing 611 and the second casing 612 are aligned in the lateral direction and joined to each other, each locking claw 632 is inserted into the insertion hole of the corresponding protruding piece 631. Consequently, the protruding piece 631 and the locking claw 632 are firmly coupled together, that is, the first casing 611 and the second casing 612 are coupled together. A coupling unit (not shown) having the same configuration as the coupling unit 63 is also provided in a lower portion of the casing 61.

As shown in FIG. 7, a toner conveyance path 36 for conveying toner is provided inside the casing 61. The toner conveyance path 36 is a path for conveying the toner supplied from the toner container 3 to the developing device 44. In the present embodiment, the toner conveyance path 36 extends in the left-right direction 8 in the casing 61. The toner conveyance path 36 is divided into four passages corresponding to the four toner containers 3, respectively. Adjacent portions of the respective passages are sealed by a seal member 37 so that different color toners may not be mixed in the toner conveyance path 36.

As shown in FIG. 7, the conveying member 65 in a spiral form is provided inside the casing 61 for the purpose of conveying the toner in the toner conveyance path 36. The conveying member 65 is provided on the toner conveyance path 36. The conveying member 65 is a spiral shaft member, in which a spiral blade is provided on a rotation shaft extending along the longitudinal direction (left-right direction 8) of the toner conveyance path 36. When the conveying member 65 rotates by receiving the driving force, the toner is conveyed in one direction in the toner conveyance path 36. In the present embodiment, the conveying member 65 conveys the toner, which is supplied from the toner container 3 through the acceptance port 38 (described later), toward a communication port 39 (described later) of the toner guide 62. The toner conveyed to the communication port 39 falls downward while guided by the toner guide 62, reaches the supply port 44C through a lower supply port 66 (toner supply port) at the lower end of the toner guide 62, and enters the inside of the developing device 44 through the supply port 44C.

As shown in FIGS. 8 and 9, a plurality of acceptance ports 38 are provided in the upper portion of the casing 61. Each acceptance port 38 is an opening, into which the toner from the toner container 3 flows. In the present embodiment, four acceptance ports 38 are provided in the upper portion of the casing 61 correspondingly to the four toner containers 3. Each acceptance port 38 is formed in the upper surface of the first casing 611. The acceptance ports 38 are arranged at a predetermined distance from one another in the left-right direction 8 in the upper portion of the casing 61. Each acceptance port 38 passes through an upper wall surface of the casing 61 downward to communicate with the toner conveyance path 36. The toner supplied from the toner container 3 flows into the acceptance port 38. The guide passage 38A (see FIG. 7) for guiding the toner, which is supplied from the toner container 3 through the acceptance port 38, to the toner conveyance path 36 is formed in a portion extending from each acceptance port 38 to the toner conveyance path 36. A configuration including the acceptance port 38 and the guide passage 38A corresponds to the toner acceptor of the present disclosure.

Each acceptance port 38 is provided at a position allowing the relevant acceptance port 38 to communicate with the toner discharge port 32 (see FIG. 7) formed in the corresponding toner container 3 in a mounting state, in which the corresponding toner container 3 is mounted in the container mounting part 30 (hereinafter referred to as "container mounted state"). That is, in the container mounted state, the acceptance port 38 is provided below the toner discharge port 32. In order to prevent toner leakage from the toner discharge port 32, the toner discharge port 32 is brought into close contact with the acceptance port 38 in the container mounted state.

Four communication ports 39 are formed in a lower wall surface 61A (see FIG. 7) of the casing 61. Each communication port 39 is provided for one passage of the toner conveyance path 36 corresponding to one color toner. As shown in FIG. 7, the toner guides 62 are provided correspondingly to the respective communication ports 39.

Figure 11:
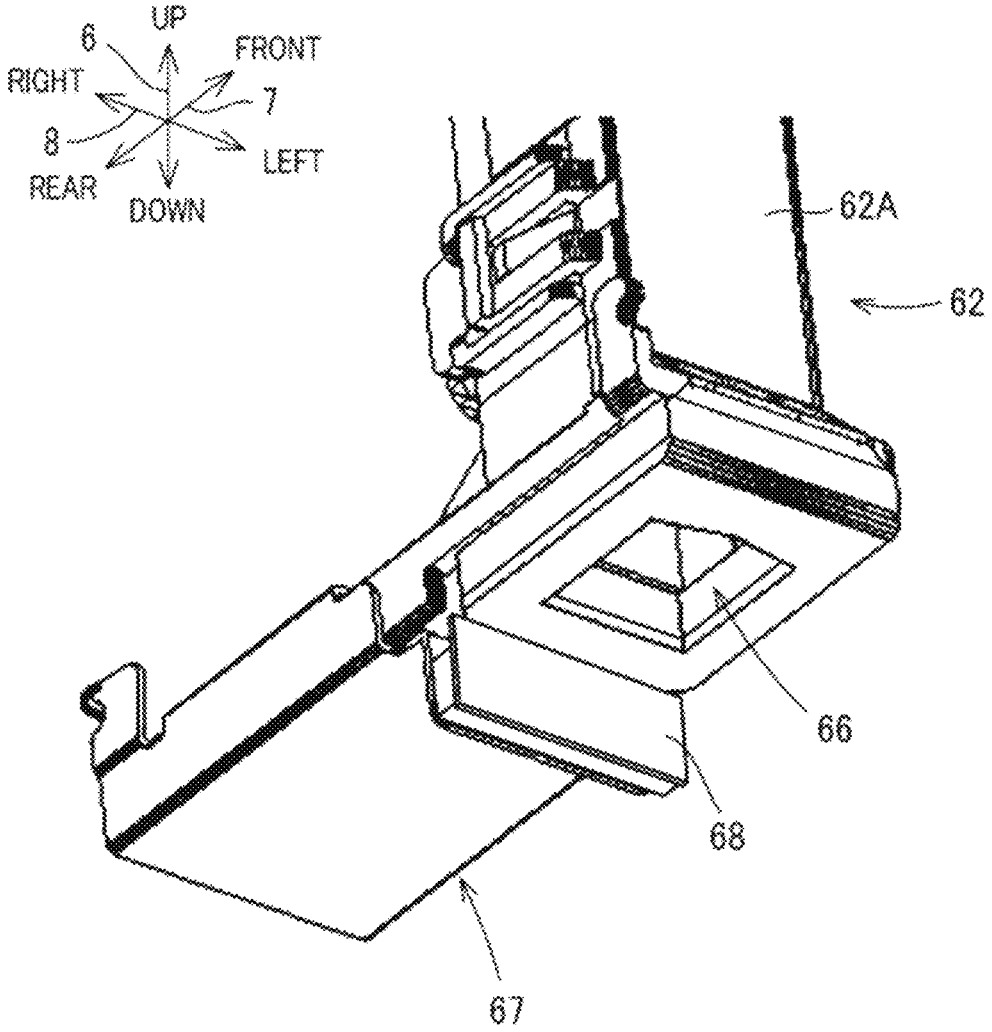
FIG. 11 is a perspective view illustrating a toner guide included in the toner conveying device.

FIG. 11 is an enlarged perspective view of the toner guide 62. The toner guide 62 includes a guiding section 62A in a tubular shape having a quadrangular cross section and extending downward from the communication port 39. The inside of the guiding section 62A constitutes a passage, through which the toner is guided downward. The upper end of the toner guide 62 is coupled to the communication port 39. The lower supply port 66 is formed in a lower end portion of the toner guide 62. The toner flowing into the toner guide 62 through the communication port 39 moves downward by the toner's own weight while guided by the guiding section 62A.

A shutter member 67 is provided in a lower end portion of the toner guide 62. The shutter member 67 is a member for opening and closing the lower supply port 66, and is supported on a lower end portion of the toner guide slidably between a closing position allowing the shutter member 67 to close the lower supply port 66 and an opening position (position shown in FIG. 11) allowing the shutter member 67 to open the lower supply port 66. The shutter member 67 is urged by a spring member (not shown) in a closing direction from the opening position toward the closing position. When the developing device 44 is mounted at the mounting position in the housing 11, part of the developing device 44 presses an abutment 68 of the shutter member 67 rearward. Receiving the pressing force at this time, the shutter member 67 moves in the opening direction from the closing position toward the opening position against the urging force of the spring member. Thus, the lower supply port 66 is opened, and the toner moving downward in the toner guide 62 can flow into the developing device 44.

Each of the acceptance ports 38 accepts the toner supplied from the toner container 3 and guides the toner to the toner conveyance path 36. For this reason, the toner may adhere to and deposit on the inner surface of the guide passage 38A extending from the acceptance port 38 to the toner conveyance path 36, thereby inhibiting the movement of the toner in the guide passage 38A. In the present embodiment, a vibration unit 70, which will be described later, is attached to the casing 61. The number of vibration motors 72 installed in the vibration unit 70 is smaller than the number of the acceptance ports 38. The vibration motors 72 transmit an appropriate vibration to all the acceptance ports 38 and guide passages 38A to effectively remove toner deposits on the inner surfaces of the respective guide passages 38A.

[Vibration Unit 701]

Figure 12:
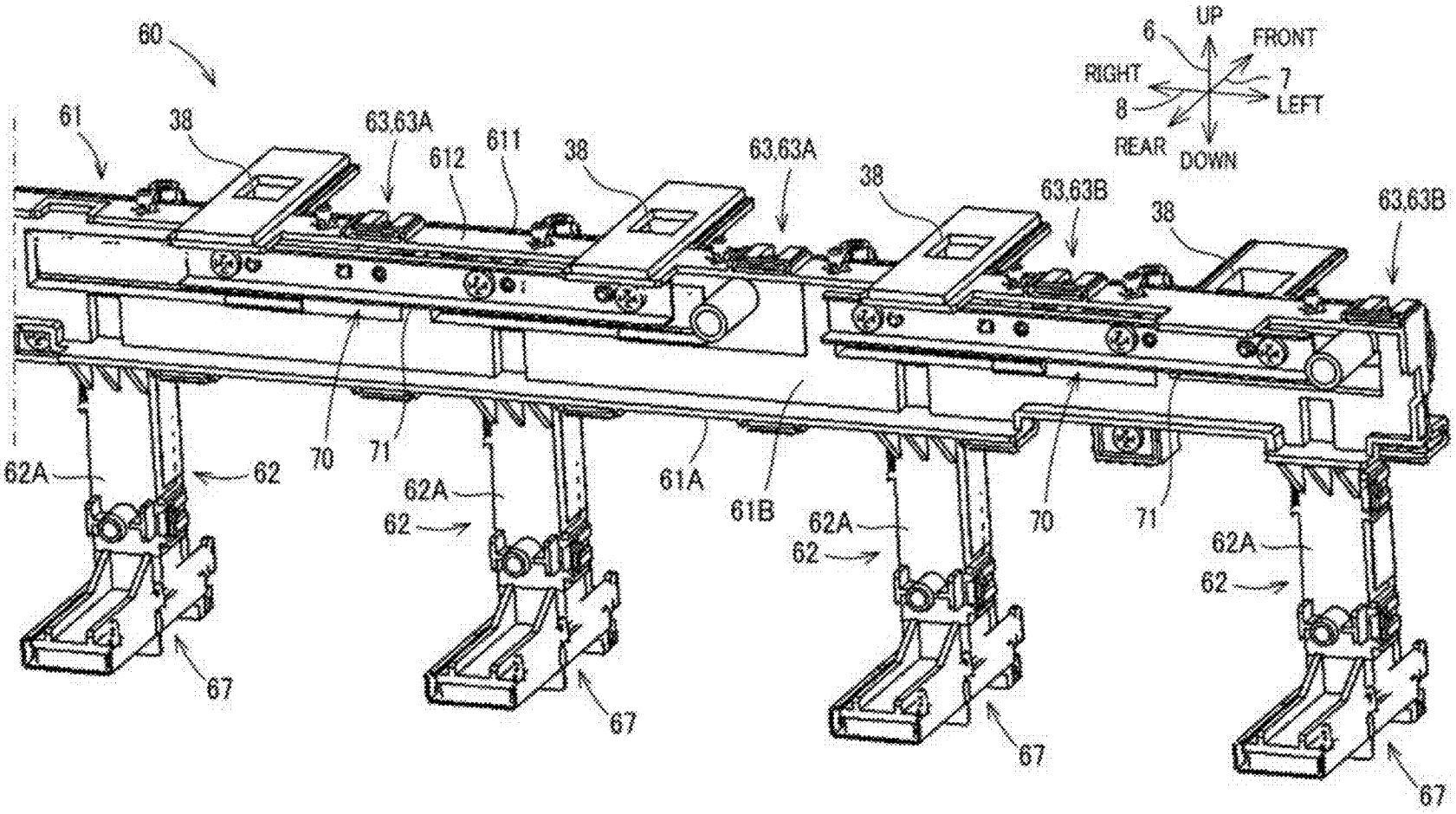
FIG. 12 is a perspective view illustrating a side surface of the casing included in the toner conveying device.
Figure 13:
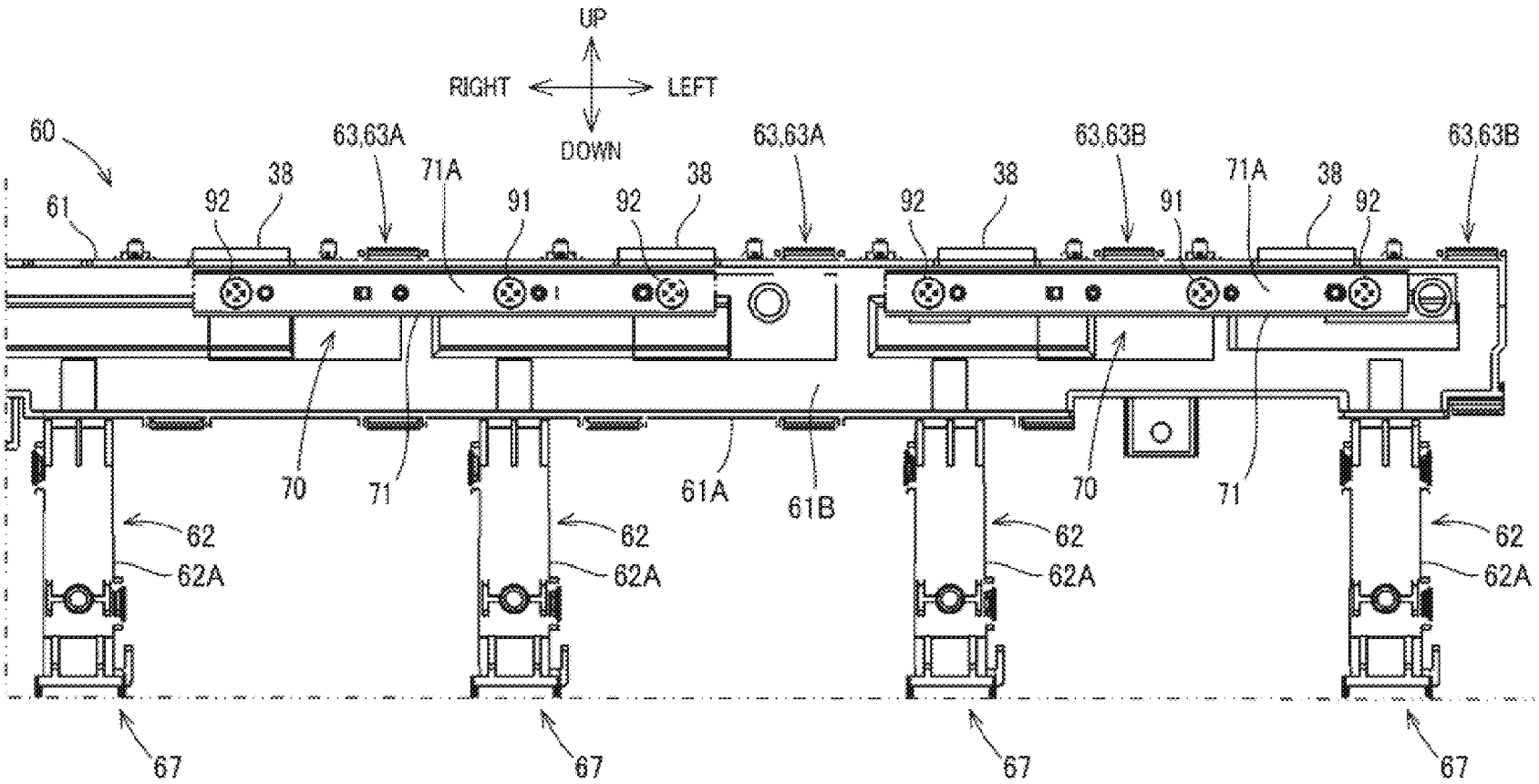
FIG. 13 is a side view illustrating the side surface of the casing included in the toner conveying device.
Figure 14:
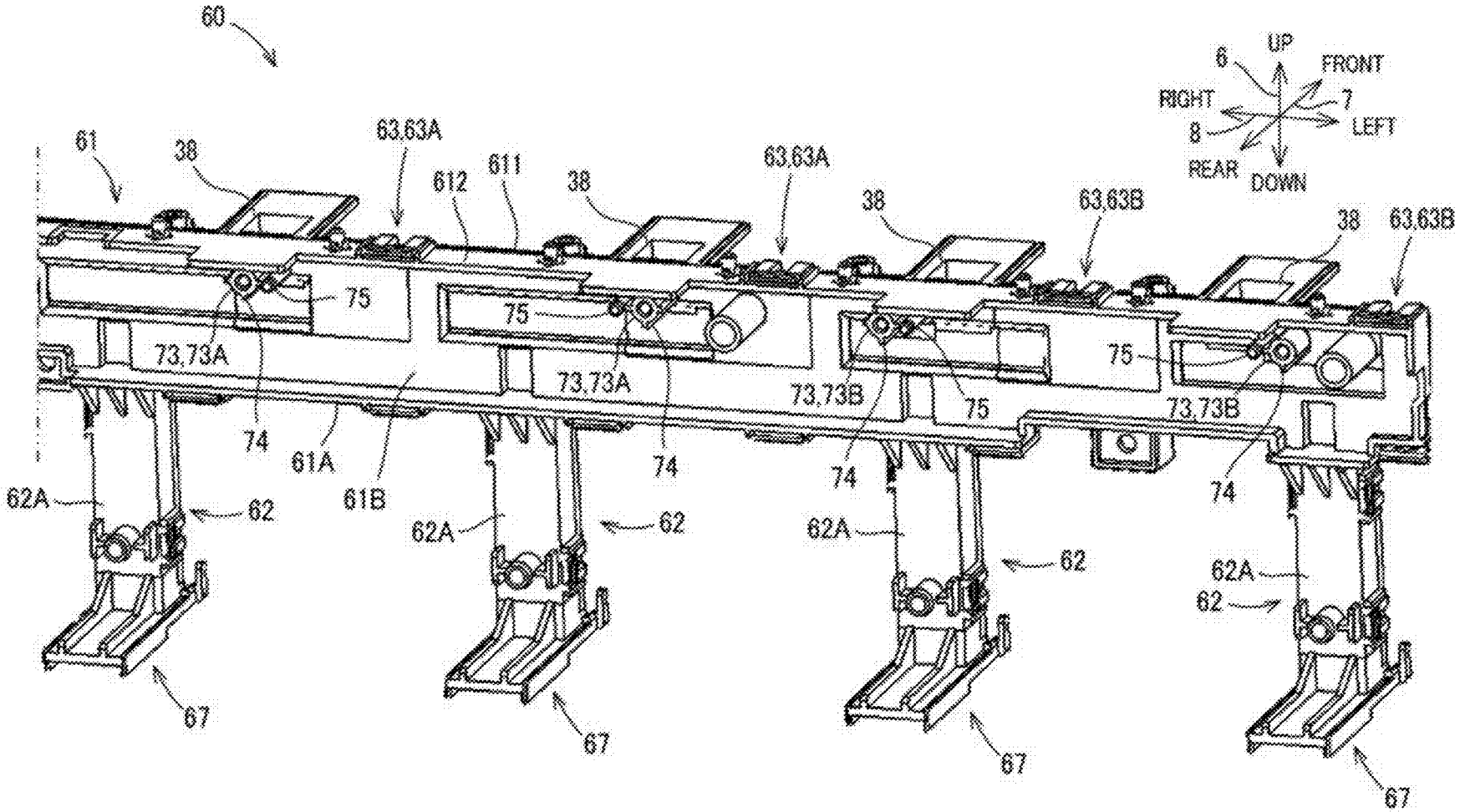
FIG. 14 is a perspective view illustrating a state, where a vibration unit is removed from the casing included in the toner conveying device.

FIGS. 12 to 14 are diagrams illustrating the configuration of a side surface of the casing 61. FIG. 14 illustrates a state, in which the vibration unit 70 is removed from the casing 61. As shown in FIG. 12 and the like, the vibration unit 70 is provided on a side surface 61B on the rear side of the casing 61, that is, on the side surface 61B on the rear side of the second casing 612. In the present embodiment, two vibration units 70 have the same configuration, and are provided on the side surface 61B of the casing 61 at a predetermined interval in the longitudinal direction of the casing 61.

The two vibration units 70 are so constructed as to impart an appropriate vibration to all the four acceptance ports 38 and four guide passages 38A so that no toner may deposit on any of the four acceptance ports 38 and four guide passages 38A. Each vibration unit 70 includes a bracket 71 and the vibration motor 72 (an example of the vibration generator of the present disclosure).

The bracket 71 is fixed to the side surface 61B via a boss 73 (an example of the leg of the present disclosure) provided on the side surface 61B, the boss 73 being described later. The bracket 71 is made of a material having a natural frequency higher than that of the casing 61 and, in the present embodiment, formed in a platelike shape with a sheet metal member of a carbon steel, an alloy steel or the like. The bracket 71 is formed in a shape elongated along the longitudinal direction of the casing 61. Further, in order to attain higher strength and rigidity, both end portions in the lateral direction (upper end portion and lower end portion) of the bracket 71 are bent outward by 90 degrees.

Figure 15:
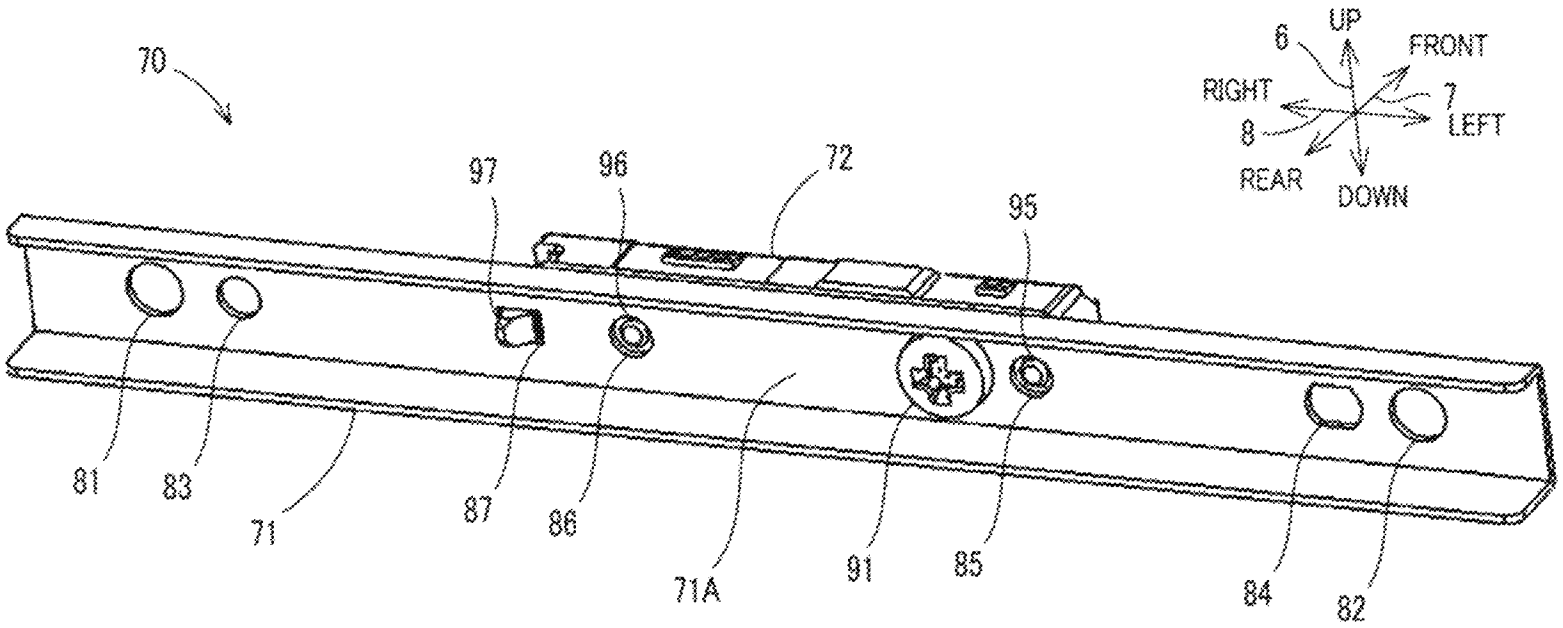
FIG. 15 is a perspective view illustrating a vibration unit included in the toner conveying device.
Figure 16:
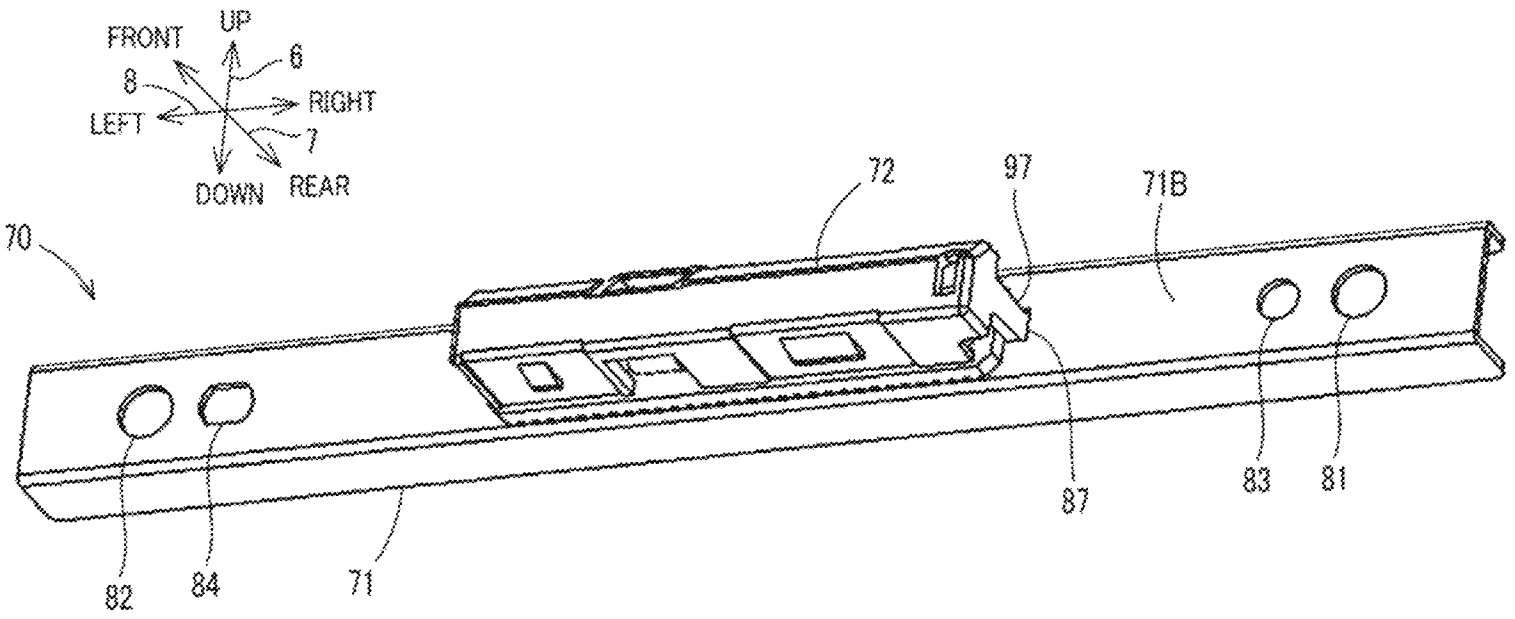
FIG. 16 is a perspective view illustrating the vibration unit included in the toner conveying device.
Figure 17:
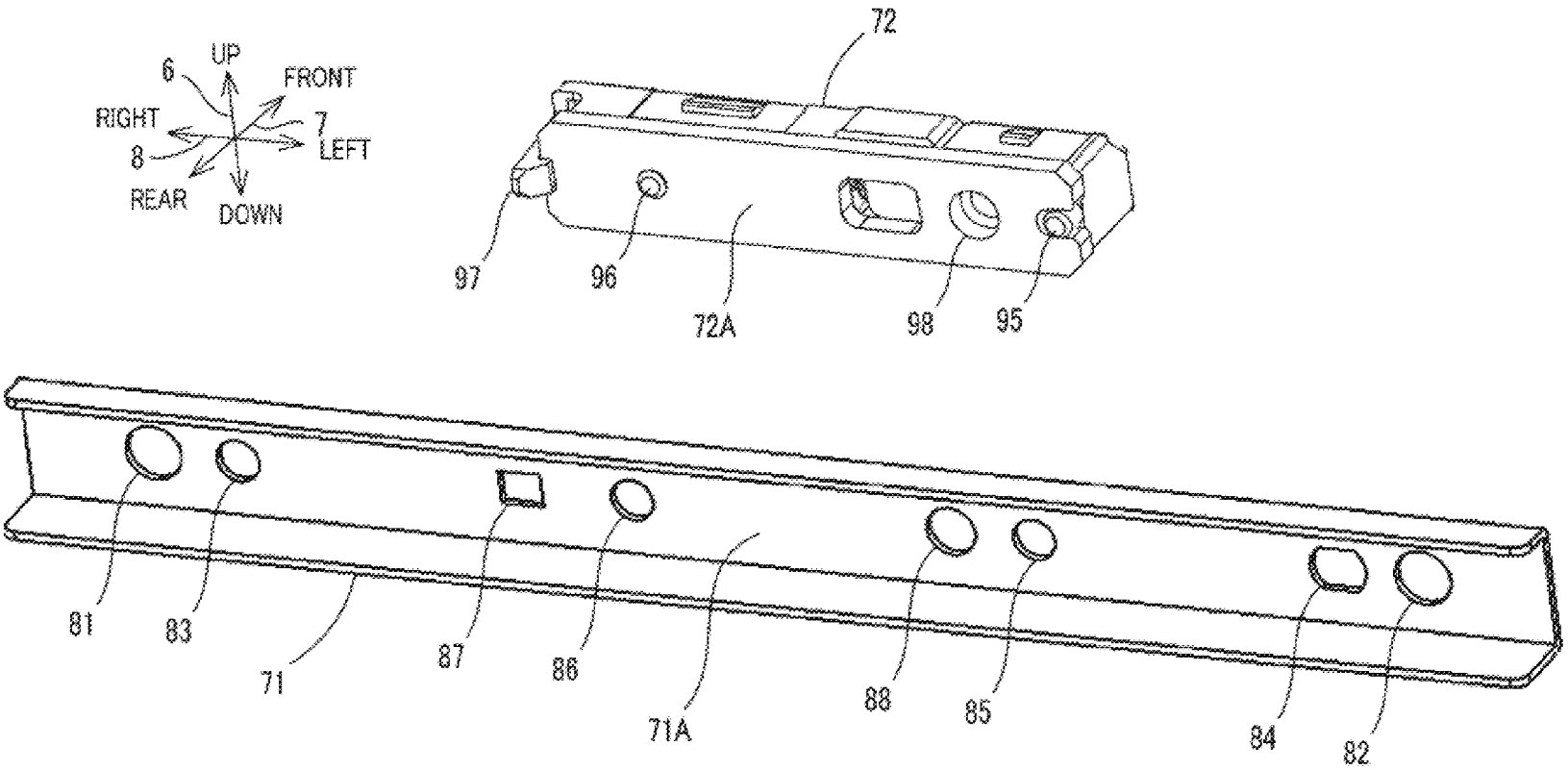
FIG. 17 is an exploded view of the vibration unit included in the toner conveying device.

FIGS. 15 and 16 are perspective views showing the vibration unit 70 alone. FIG. 17 is an exploded perspective view of the vibration unit 70. As shown in FIG. 15 and the like, a plurality of openings 81 to 88 penetrating the bracket 71 are formed in a side surface 71A on one side (rear side) of the bracket 71. The openings 81 and 82 are formed in both end portions in the longitudinal direction of the bracket 71, respectively. The opening 83 having a diameter smaller than that of the opening 81 is formed in the vicinity of the opening 81 in one end portion, and the opening 84 having a diameter smaller than that of the opening 82 is also formed in the vicinity of the opening 82 in the other end portion. The openings 83 and 84 are used when the bracket 71 is temporarily fixed to the side surface 61B of the casing 61. The openings 81 and 82 are used to firmly fix the bracket 71, which is temporarily fixed to the side surface 61B, with a screw 92 (see FIG. 13) or the like.

As shown in FIG. 16, the vibration motor 72 is attached to a side surface 71B (an example of the facing surface of the present disclosure) on the other side (front side) of the bracket 71. Consequently, the vibration motor 72 is disposed in the space between the side surface 71B and the side surface 61B. The vibration motor 72 of each of the two vibration units is, for example, a DC motor, in which an eccentric weight is fixed to an output shaft, and each vibration motor 72 is driven by the supply of a DC current under the control of a controller (not shown). When the vibration motor 72 is rotationally driven to rotate the eccentric weight, vibration is generated. The generated vibration is transmitted to the side surface 61B of the casing 61 through the bracket 71 and the boss 73. Note that the vibration motor 72 is merely an example of the vibration generator, and a vibration generator of any configuration may be used as long as the vibration generator is capable of generating vibration.

As shown in FIG. 17, three positioning pins 95 to 97 are provided on an attachment surface 72A of the vibration motor 72. The positioning pins 95 to 97 of the vibration motor 72 are inserted into the openings 85 to 87 formed in the bracket 71, respectively, so as to temporarily fix the vibration motor 72 to the side surface 71B of the bracket 71. In such state of the vibration motor 72 being temporarily fixed, a screw 91 (see FIG. 15) is screwed into a threaded hole 98 formed in the vibration motor 72 through the opening 88. Thus, the vibration motor 72 is firmly fixed to the side surface 71B of the bracket 71.

As shown in FIG. 14, four cylindrical bosses 73 are provided on the side surface 61B of the casing 61. In other words, each boss 73 is provided on the side surface 61B on the rear side of the second casing 612. Each boss 73 supports the bracket 71. Each boss 73 protrudes outward (rearward) from the side surface 61B of the casing 61. The bosses 73 are provided on the side surface 61B at predetermined intervals along the longitudinal direction of the casing 61. To a pair of bosses 73A on the right side out of the four bosses 73, one vibration unit 70 is attached, and the other vibration unit 70 is attached to a pair of bosses 73B on the left side. The distance between the bosses 73A is the same as the distance between the bosses 73B.

A reinforcing rib 74 is formed on each boss 73. One or more reinforcing ribs 74 are formed on the outer peripheral surface of each boss 73. The reinforcing rib or ribs 74 extend in the protruding direction of the relevant boss 73.

A positioning pin 75 for temporary fixing is provided in the vicinity of each boss 73. The positioning pin 75 is formed integrally with the casing 61. By inserting the respective positioning pins 75 through the openings 81 and 82 of the brackets 71, the vibration units 70 are temporarily fixed to the side surface 61B of the casing 61. In such state of the vibration units 70 being temporarily fixed, screws 92 (see FIG. 13) are screwed into threaded holes formed in the corresponding bosses 73 through the openings 81 and 82.

Thus, the vibration units 70 are firmly fixed to the side surface 61B of the casing 61.

Each boss 73 is formed integrally with the casing 61. That is, the bosses 73 are made of the same material as the casing 61. Each boss 73 is provided at a position corresponding to the acceptance port 38 in an upper end portion of the side surface 61B of the casing 61. The four bosses 73 have the same protrusion length. In the present embodiment, the bosses 73 are each fixed at a position near one of the acceptance ports 38 on the casing 61. To be specific, the pair of bosses 73A is provided immediately below the corresponding acceptance ports 38, and the pair of bosses 73B is provided in the vicinity of the corresponding acceptance ports 38. In addition, in the present embodiment, each boss 73 is provided in the vicinity of the coupling unit 63.

As described above, in the toner conveying device 60 of the present embodiment, the vibration unit 70 with the configuration as above is fixed to the side surface 61B of the casing 61. Consequently, when the vibration motor 72 of the vibration unit 70 is driven by the controller, the vibration generated by the vibration motor 72 is transmitted to the side surface 61B of the casing 61 via the bracket 71 and the bosses 73. Since the bosses 73 are each fixed at a position near one of the two acceptance ports 38 on the casing 61 as described above, the vibration transmitted from the bosses 73 to the casing 61 is transmitted to the corresponding two acceptance ports 38 and two guide passages 38A without being considerably attenuated. As a result, it is possible to effectively remove the toner deposits on the corresponding two acceptance ports 38 and two guide passages 38A, and to prevent the toner from adhering to the acceptance ports 38 and the inner surfaces of the guide passages 38A. In addition, according to the above-described vibration unit 70, the vibration of one vibration motor 72 is transmitted to the corresponding two acceptance ports 38 and two guide passages 38A, so that the number of vibration motors 72 to be installed is reduced compared to a configuration, in which the vibration motor 72 is provided for each of a plurality of acceptance ports 38 and a plurality of guide passages 38A.

In the present embodiment, the vibration motor 72 is attached to the side surface 71B of the bracket 71, and the vibration motor 72 is disposed in the space between the side surface 71B of the bracket 71 and the side surface 61B of the casing 61. Therefore, since the vibration motor 72 is not exposed to the outside of the casing 61, it is possible to reduce the space outside the side surface 61B of the casing 61. In addition, the vibration motor 72 is protected from external impact by the bracket 71.

In the above-described embodiment, the casing 61 has a configuration, in which the first casing 611 and the second casing 612 are coupled together in the front-rear direction 7, the acceptance port 38 and the guide passage 38A are provided on the first casing 611, and the boss 73 is provided on the side surface 61B of the second casing 612. In such configuration, the boss 73 is provided at a position corresponding to the acceptance port 38 and the guide passage 38A in the upper end portion of the side surface 61B, and the coupling unit 63 is provided in the vicinity of the acceptance port 38 and the guide passage 38A. Therefore, the vibration of the vibration unit 70 is transmitted to the acceptance port 38 and the guide passage 38A through two paths. That is, the vibration is transmitted from the boss 73 to the acceptance port 38 and the guide passage 38A via the second casing 612, a joint portion (not shown) with the second casing 612, and the first casing 611, and the vibration is transmitted from the boss 73 to the acceptance port 38 and the guide passage 38A via the second casing 612, the coupling unit 63, and the first casing 611. Thus, the vibration is transmitted to the acceptance port 38 and the guide passage 38A through the two paths, so that, in the casing 61 composed of the two members as described above, the vibration of the vibration unit 70 is effectively transmitted to the acceptance port 38 and the guide passage 38A.

In the above-described embodiment, an exemplary configuration, in which the two vibration units 70 are installed for the four acceptance ports 38 and the four guide passages 38A, is illustrated, to which configuration the present disclosure is not limited. For example, the vibration unit 70 may include one elongated bracket to be supported by the four bosses 73 and one or two vibration motors fixed to the bracket.

In the above-described embodiment, an exemplary configuration, in which the vibration unit 70 is attached to the side surface 61B of the casing 61, is illustrated. The vibration unit 70, however, may be attached to a side surface of the casing 61 opposite with the side surface 61B.

In the above-described embodiment, an exemplary configuration, in which the casing 61 is dividable into two casings, the first casing 611 and the second casing 612, is illustrated, to which configuration the present disclosure is not limited. The present disclosure is applicable to a case, in which the casing 61 is not dividable but is integrally constructed, for instance.

What is claimed is:

1. A toner conveying device that conveys toner supplied from outside, the toner conveying device comprising:

a housing having a toner conveyance path inside;

a plurality of toner acceptors provided on the housing and configured to accept toner supplied from outside and guide the toner to the toner conveyance path;

a plurality of legs fixed near the plurality of toner acceptors on the housing, respectively, and protruding outward from a side surface of the housing;

a bracket supported by each of the plurality of legs; and a vibration generator attached to the bracket, wherein the vibration generator is attached to a facing surface of the bracket that faces the side surface, wherein the vibration generator is a vibration motor transmitting vibration to the side surface of the housing through the bracket and the legs.

2. The toner conveying device according to claim 1, wherein the bracket has a natural frequency higher than the natural frequency of the housing.

3. The toner conveying device according to claim 2, wherein the housing is made of a synthetic resin, and the bracket includes a sheet metal member.

4. The toner conveying device according to claim 3, wherein the plurality of legs are integrally formed with the housing and each have a reinforcing rib extending in a protruding direction of a leg and formed on an outer peripheral surface of the leg.

5. The toner conveying device according to claim 1, wherein the housing is formed in a shape elongated in a horizontal direction, the toner conveyance path extends along a longitudinal direction of the housing, the plurality of toner acceptors are provided on an upper surface of the housing at predetermined intervals in the longitudinal direction, and each of the plurality of legs is provided at a position on the side surface that corresponds to one of the plurality of toner acceptors.

6. A toner conveying device that conveys toner supplied from outside, the toner conveying device comprising:

a housing having a toner conveyance path inside;

a plurality of toner acceptors provided on the housing and configured to accept toner supplied from outside and guide the toner to the toner conveyance path;

a plurality of legs fixed near the plurality of toner acceptors on the housing, respectively, and protruding outward from a side surface of the housing;

a bracket supported by each of the plurality of legs; and a vibration generator attached to the bracket, wherein the housing is formed in a shape elongated in a horizontal direction, the toner conveyance path extends along a longitudinal direction of the housing, the plurality of toner acceptors are provided on an upper surface of the housing at predetermined intervals in the longitudinal direction, and each of the plurality of legs is provided at a position on the side surface that corresponds to one of the plurality of toner acceptors, wherein the housing is divided in a lateral direction orthogonal to the longitudinal direction in a horizontal plane into a first divided housing and a second divided housing, the first divided housing and the second divided housing being coupled together in the lateral direction, the plurality of toner acceptors are provided on the first divided housing, the plurality of legs are provided on a side surface of the second divided housing, and a coupling member that couples the first divided housing and the second divided housing together is provided near the plurality of toner acceptors.

7. An image forming apparatus comprising:

the toner conveying device according to claim 1; and a developing device that uses the toner supplied from the toner conveying device to perform development.

* * * * *